US011545740B2

(12) United States Patent
Sung et al.

(10) Patent No.: US 11,545,740 B2
(45) Date of Patent: Jan. 3, 2023

(54) COMMUNICATION APPARATUS FOR VEHICLE

(71) Applicant: SAMSUNG ELECTRONICS CO., LTD., Suwon-si (KR)

(72) Inventors: Sangbong Sung, Suwon-si (KR); Jinu Kim, Suwon-si (KR); Yongsun Shin, Suwon-si (KR); Jeseung Oh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/278,484

(22) PCT Filed: Nov. 12, 2019

(86) PCT No.: PCT/KR2019/095046
§ 371 (c)(1),
(2) Date: Mar. 22, 2021

(87) PCT Pub. No.: WO2020/106131
PCT Pub. Date: May 28, 2020

(65) Prior Publication Data

US 2022/0037776 A1 Feb. 3, 2022

(30) Foreign Application Priority Data

Nov. 19, 2018 (KR) ..... 10-2018-0142716

(51) Int. Cl.
*H01Q 1/32* (2006.01)
*H01Q 9/16* (2006.01)

(52) U.S. Cl.
CPC ..... *H01Q 1/3291* (2013.01); *H01Q 9/16* (2013.01)

(58) Field of Classification Search
CPC ..... H01Q 1/27; H01Q 1/32; H01Q 1/3208; H01Q 1/3233; H01Q 1/325; H01Q 1/3291; H01Q 9/16; H01Q 5/40; H01Q 5/48
See application file for complete search history.

(56) References Cited

U.S. PATENT DOCUMENTS 6,433,749 B1 * 8/2002 Thompson ..... H01Q 1/1271 343/700 MS
9,083,414 B2 * 7/2015 Basnayake ..... H04B 7/10
(Continued)

FOREIGN PATENT DOCUMENTS

JP 2003-188620 7/2003
JP 2006-191671 7/2006
(Continued)

OTHER PUBLICATIONS

International Search Report for PCT/KR2019/095046, with English translation, dated Feb. 28, 2020, 4 pages.
(Continued)

*Primary Examiner* — Jason Crawford
(74) *Attorney, Agent, or Firm* — Nixon & Vanderhye, P.C.

(57) ABSTRACT

Provided is a communication apparatus for a vehicle. The communication apparatus for a vehicle comprises: a first case forming an external surface; a communication interface unit including a processor arranged inside the first case and a plurality of first connection terminals electrically connected to the processor and arranged on a first side of the first case; and a first antenna module including a plurality of first access terminals respectively coupled to be directly separable from the plurality of first connection terminals, and a first antenna electrically connected to at least one of the plurality of first access terminals, wherein the communication interface unit and the first antenna module are coupled
(Continued)

to each other as one body when the plurality of first connection terminals are connected to the plurality of first access terminals.

11 Claims, 12 Drawing Sheets

(56) References Cited

U.S. PATENT DOCUMENTS

| | | | | |
|---|---|---|---|---|
| 9,240,629 | B2 | 1/2016 | Kim | |
| 9,966,659 | B2 | 5/2018 | Chakam et al. | |
| 10,270,153 | B2 | 4/2019 | Park et al. | |
| 10,469,136 | B2 * | 11/2019 | Kim | H01Q 21/29 |
| 10,535,914 | B2 | 1/2020 | Kim | |
| 10,651,548 | B2 | 5/2020 | Kaneko et al. | |
| 10,741,903 | B1 * | 8/2020 | Kaneko | H01Q 1/42 |
| 2007/0236404 | A1 * | 10/2007 | Snider | H01Q 1/48 343/702 |
| 2012/0274519 | A1 * | 11/2012 | Chakam | H01Q 1/526 343/702 |
| 2014/0028507 | A1 * | 1/2014 | Mierke | H01Q 1/3275 343/713 |
| 2015/0071137 | A1 * | 3/2015 | Thiam | H01Q 1/521 343/702 |
| 2015/0123854 | A1 * | 5/2015 | Chakam | H01Q 1/1214 343/702 |
| 2015/0130679 | A1 | 5/2015 | Shin et al. | |
| 2017/0054204 | A1 * | 2/2017 | Changalvala | H01Q 1/42 |
| 2017/0187100 | A1 * | 6/2017 | Fotheringham | H01Q 21/0031 |
| 2017/0187101 | A1 * | 6/2017 | Freeman | H01Q 21/065 |
| 2017/0317408 | A1 * | 11/2017 | Hamada | B62D 25/06 |
| 2018/0019512 | A1 * | 1/2018 | Ortigosa | H01Q 1/241 |
| 2018/0301796 | A1 * | 10/2018 | Yamase | H01Q 21/30 |
| 2019/0273310 | A1 * | 9/2019 | Sone | H01Q 21/205 |
| 2020/0185818 | A1 * | 6/2020 | Kim | H01Q 5/25 |
| 2020/0185820 | A1 * | 6/2020 | Shin | H01Q 13/16 |
| 2020/0350663 | A1 * | 11/2020 | Ambe | B60R 11/02 |
| 2021/0098866 | A1 * | 4/2021 | Kim | H01Q 5/378 |
| 2021/0305687 | A1 * | 9/2021 | Kim | H01Q 21/065 |
| 2022/0037776 | A1 * | 2/2022 | Sung | H01Q 21/28 |

FOREIGN PATENT DOCUMENTS

| | | |
|---|---|---|
| JP | 2014-075646 | 4/2014 |
| JP | 10-2015-0053340 | 5/2015 |
| JP | 2017-228860 | 12/2017 |
| JP | 2017-228871 | 12/2017 |
| KR | 10-2009-0070189 | 7/2009 |
| KR | 10-2010-0041255 | 4/2010 |
| KR | 10-1041356 | 6/2011 |
| KR | 10-2012-0065812 | 6/2012 |
| KR | 10-2015-0022795 | 3/2015 |
| KR | 10-2016-0108999 | 9/2016 |
| WO | 2014/178494 | 11/2014 |
| WO | 2016/200133 | 12/2016 |

OTHER PUBLICATIONS

Written Opinion of the ISA for PCT/KR2019/095046, with English translation, dated Feb. 28, 2020, 9 pages.

Office Action for 10-2018-0142716, dated Jul. 14, 2020, with English translation, 11 pages.

* cited by examiner

COMMUNICATION APPARATUS FOR VEHICLE

This application is the U.S. national phase of International Application No. PCT/KR2019/095046 filed 12 Nov. 2019, which designated the U.S. and claims priority to KR Patent Application No. 10-2018-0142716 filed 19 Nov. 2018, the entire contents of each of which are hereby incorporated by reference.

FIELD

The disclosure relates to a communication apparatus for a vehicle with improved radiation efficiency and is miniaturized.

DESCRIPTION OF RELATED ART

A communication apparatuses for a vehicle may be an apparatus for transmitting and receiving information necessary to a user of a vehicle. Recently, the amount of information provided to a user has been increasing with the development of various information media, and accordingly, antennas for vehicles have also come to transmit and receive much information.

In particular, the communication apparatus for a vehicle may, through a plurality of antennas arranged in a shark fin antenna positioned on a rear surface roof, have come to perform GPS communication for transmitting and receiving location information of a vehicle, vehicle to everything communication (V2X) for communication with an outside of the vehicle, or the like.

However, the communication apparatus for a vehicle according to the related art has the problem of signal loss occurring, and manufacturing costs increasing according to a length of a cable because of an antenna which transmits and receives information signal and a telematics control unit (TCU) which processes the signal transmitted and received from the antenna are connected to each other by cable.

Further, the shark fin antenna had the problem of not being able to accommodate an additional antenna for transmitting and receiving additional information for spatial reasons.

SUMMARY

An aspect of the disclosure is to provide a communication apparatus for a vehicle with improved radiation efficiency and of a new miniaturized structure.

According to an embodiment of the disclosure, a communication interface unit including a first case forming an outer surface, a processor disposed inside the first case, and a plurality of first receptacle terminals configured to be electrically connected with the processor and disposed at a first side of the first case, and a first antenna module including a plurality of first connection terminals coupled to be directly separable from the plurality of first receptacle terminals and a first antenna electrically connected with at least one from among the plurality of first connection terminals are included, and based on the plurality of first receptacle terminals and the plurality of first connection terminals being connected, the communication interface unit and the first antenna module are coupled as one body.

The first antenna module may be coupled to be separable from a side surface of the first case.

The communication interface unit and the first antenna module may be disposed at a lower portion of a roof of a vehicle.

The plurality of first connection terminals may include connection terminals of a number corresponding to a number of antennas included in the first antenna module, and a number of the plurality of first receptacle terminals may be the same or more than a number of the plurality of first connection terminals.

The communication interface unit may further include a plurality of second receptacle terminals disposed at a second side of the first case, and the communication apparatus for a vehicle further includes a second antenna module including a plurality of second connection terminals coupled to be directly separable from the plurality of second receptacle terminals and a second antenna which is electrically connected with the plurality of second connection terminals.

The second antenna module may be disposed to face the first antenna module.

The first antenna module may include a first dipole antenna and a second dipole antenna disposed so that a radiation direction is different from the first dipole antenna.

The first dipole antenna may be disposed in a minor axis direction of the antenna module, and the second dipole antenna may be disposed in a major axis direction of the antenna module.

A third antenna module may be included, and the third antenna module may include a second case of a shark fin shape, a printed circuit board forming a lower surface of the second case, and at least one of a third antenna disposed on the printed circuit board.

The third antenna module may be disposed at an upper surface of the communication interface unit.

The third antenna module may further include at least one of a fourth antenna disposed at a lower portion of the printed circuit board.

The at least one of the fourth antennas may be disposed at an extending surface which is connected to a lower surface of the printed circuit board.

The third antenna module may further include a first additional antenna and a second additional antenna disposed to face the first additional antenna, and the extending surface may include a first extending surface on which the first additional antenna is disposed and a second extending surface disposed spaced apart from the first extending surface to face each other, and on which the second additional antenna is disposed.

The at least one of the third antennas and the first and second additional antennas may be configured to operate as a MIMO antenna.

The communication interface unit may include at least one from among a BLE antenna and a WiFi antenna.

The communication interface unit may include the printed circuit board disposed inside the first case, and the plurality of first receptacle terminals may be disposed on the printed circuit board and electrically connected with the printed circuit board.

The plurality of first receptacle terminals and the plurality of first connection terminals may be screw coupled.

DETAILED DESCRIPTION OF EXAMPLE EMBODIMENTS

To sufficiently understand the configuration and effect of the disclosure, the exemplary embodiments of the disclosure will be explained with reference to the attached drawings. However, it is to be understood that the disclosure is not limited to the embodiments disclosed below, and that the embodiments may be implemented to various forms and various modifications may be applied thereto. Only, the descriptions of the embodiments are to complete the descriptions of the disclosure, and are provided to fully convey the scope of the disclosure to one of ordinary skill in the art to which the disclosure pertains. For convenience of description, elements in the attached drawings have been illustrated enlarged in size compared with the actual size, and a ratio of each element may be exaggerated or reduced.

It will be further understood that when an element is disclosed as "on" or "in contact with" another element, the element may be in direct contact with or connected to another element, or may have still another element present therebetween. Alternatively, when an element is described as being "directly on" or "directly connected to" another element, it is to be understood that still another element may not be present therebetween. Other expressions that describe the relationship between the elements such as, for example, "between . . . " and "directly between . . . ," should be interpreted the same.

The terms such as "first," "second," and so on may be used to describe a variety of elements, but the elements should not be limited by these terms. The terms may be used only for the purpose of distinguishing one element from another. For example, a first element may be designated as a second element without departing from the scope and spirit of the present disclosure, and similarly, the second element may also be designated as the first element.

A singular expression includes a plural expression, unless otherwise specified clearly in context. It is to be understood that the terms such as "comprise" or "include" may be used herein to designate a presence of a characteristic, number, step, operation, element, component, or a combination thereof, and not to preclude a presence or a possibility of adding one or more of other characteristics, numbers, steps, operations, elements, components or a combination thereof.

The terms used in the embodiments of the disclosure may be interpreted to have meanings generally understood to one of ordinary skill in the art unless otherwise defined.

Figure 1:
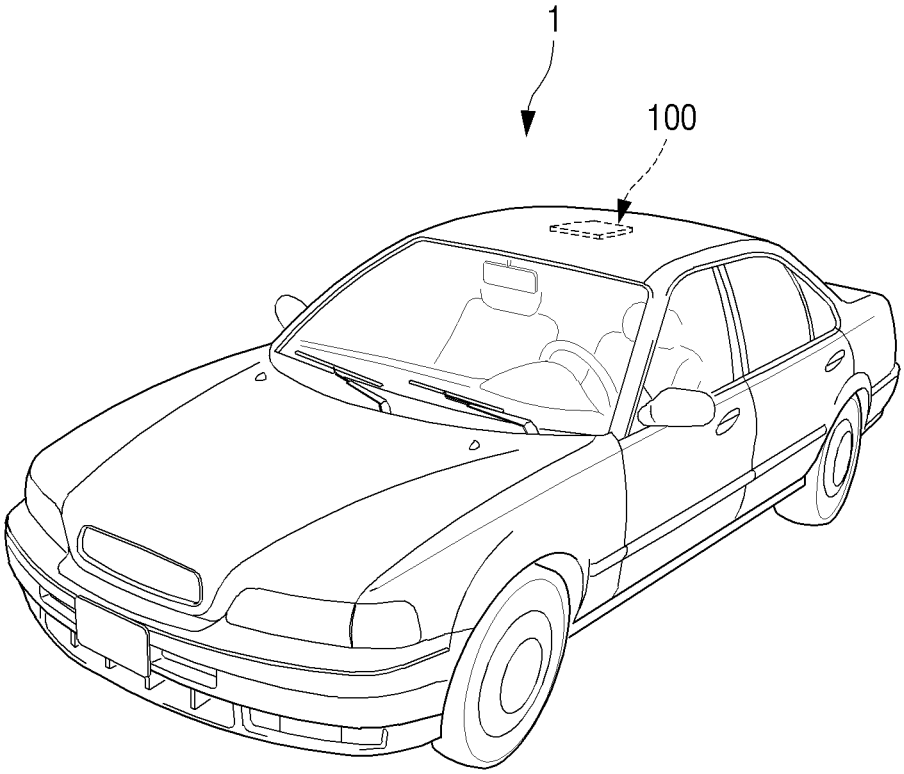
FIG. 1 is a perspective view illustrating a vehicle according to an embodiment of the disclosure.

FIG. 1 is a perspective view illustrating a vehicle 1 according to an embodiment of the disclosure.

The communication apparatus for a vehicle 100 may be installed in a vehicle 1. Specifically, the communication apparatus for a vehicle 100 may be configured such that one surface is disposed to be form an outer surface of the vehicle 1, or disposed inside of the outer surface of the vehicle 1.

For example, the communication apparatus for a vehicle 100 may be disposed at a lower portion of a roof of a vehicle 1. Specifically, the communication interface unit 110 and a first antenna module 120 may be disposed at the lower portion of the roof of the vehicle.

The communication apparatus for a vehicle 100 may receive information necessary to a user using a vehicle 1 such as road traffic information, radio broadcast, or vehicle location information, road traffic information necessary in autonomous driving of the vehicle 1, or the like from an external apparatus (not shown), or transmit to the external apparatus.

In addition, the communication apparatus for a vehicle 100 may support various communication protocols. For example, a wireless communication may include a cellular communication using at least one from among, for example, and without limitation, an LTE, an LTE Advance (LTE-A), a code division multiple access (CDMA), a wideband CDMA (WCDMA), a universal mobile telecommunications system (UMTS), a Wireless Broadband (WiBro), a Global System for Mobile Communications (GSM), or the like.

For example, the wireless communication may include at least one from among a wireless fidelity (WiFi), Bluetooth, Bluetooth lower energy (BLE), Zigbee, a near field communication (NFC), a Magnetic Secure Transmission, a radio frequency (RF), or a body area network (BAN). According to an embodiment, the wireless communication may include a GNSS. The GNSS may, for example, be a Global Positioning System (GPS), a Global Navigation Satellite System (Glonass), a Beidou Navigation Satellite System (hereinafter, "Beidou"), or a Galileo, the European global satellite-based navigation system. In the disclosure below, "GPS" may be used interchangeably with "GNSS."

The external apparatus (not shown) may be a communication apparatus capable of transmitting signals to and receiving signals from a base station, a broadcasting apparatus, a radio broadcasting apparatus, a satellite signal transmitting and receiving apparatus (e.g., GPS), a user terminal, or the like.

In addition, the external apparatus may be a communication apparatus which supports a vehicle to everything (V2X) communication. Additionally, the external apparatus may include a variety of apparatuses capable of transmitting and receiving a signal through a wireless communication or a wired communication.

The specific structure of the communication apparatus for a vehicle 100 will be described below with reference to FIGS. 2 to 5.

Figure 2:
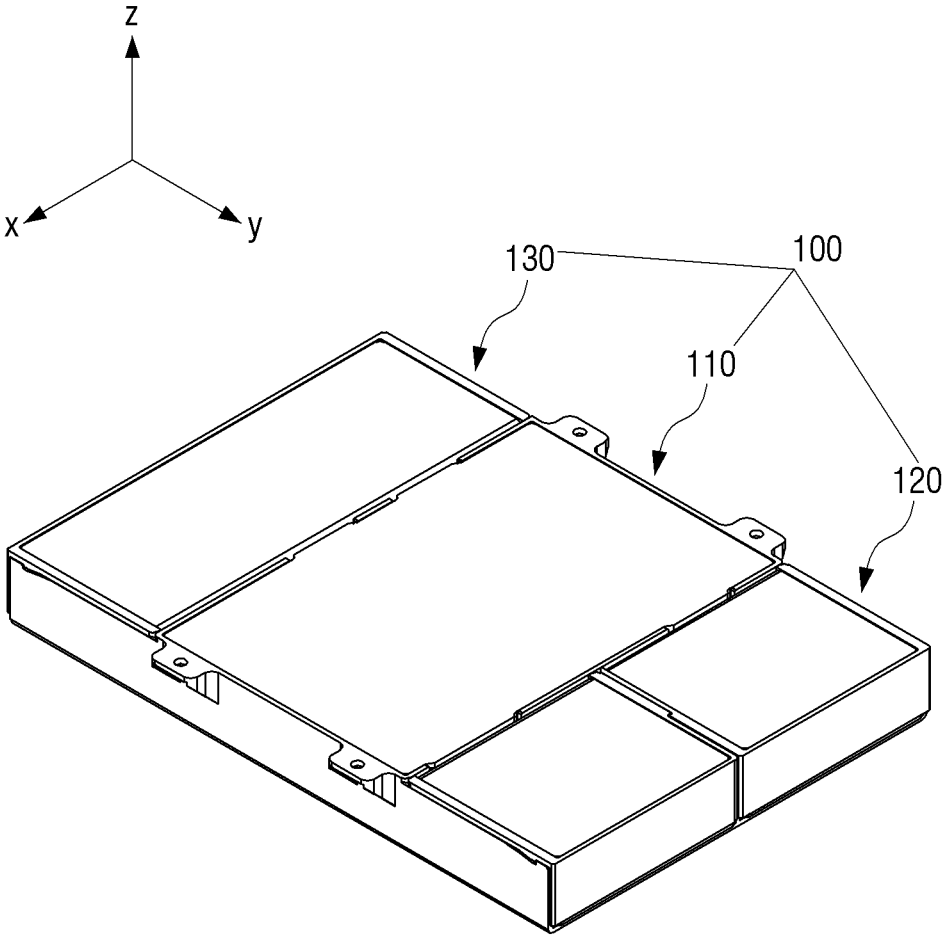
FIG. 2 is a perspective view illustrating a communication apparatus for a vehicle according to an embodiment of the disclosure.
Figure 3:
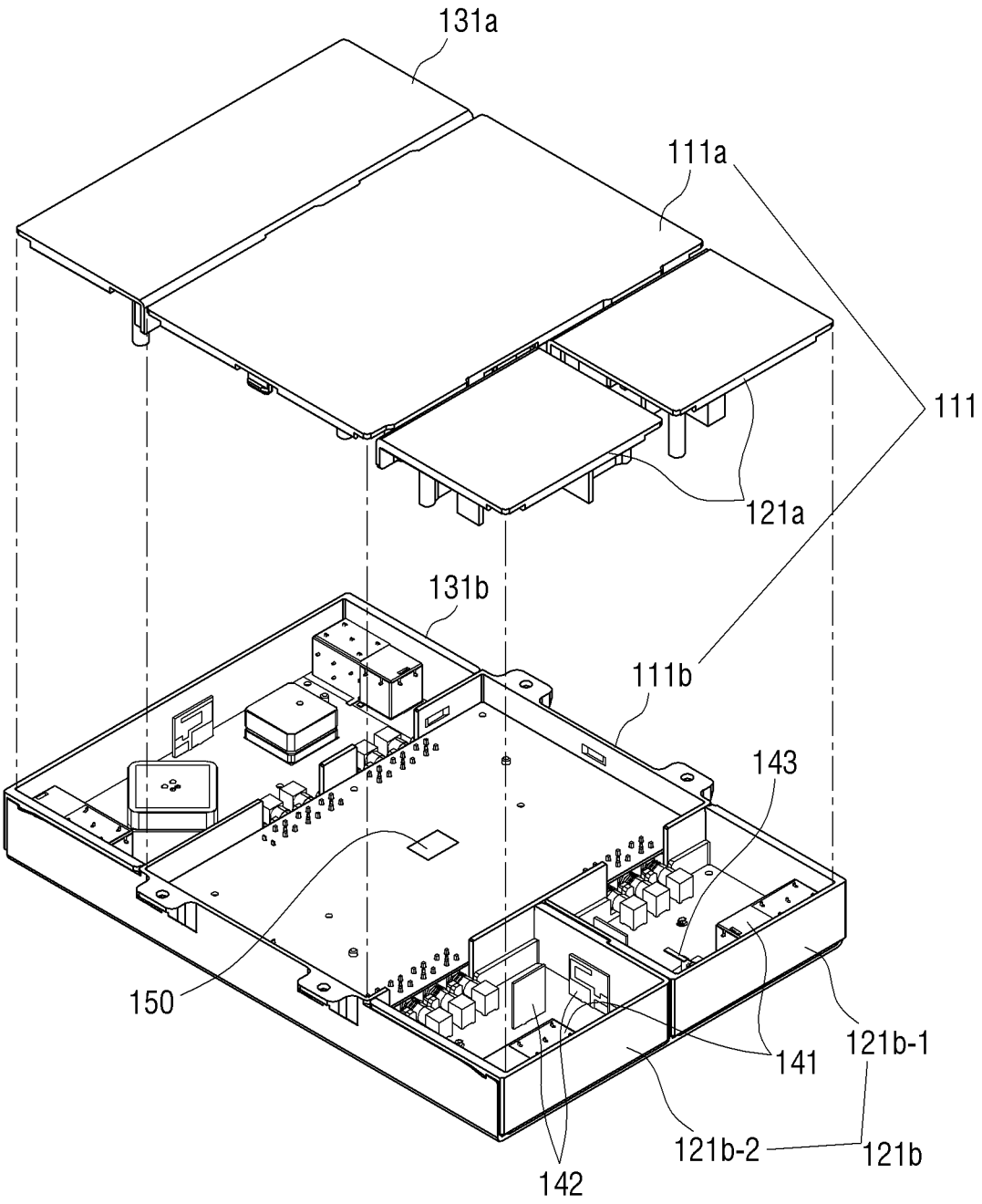
FIG. 3 is an exploded perspective view illustrating a communication apparatus for a vehicle according to an embodiment of the disclosure.
Figure 4:
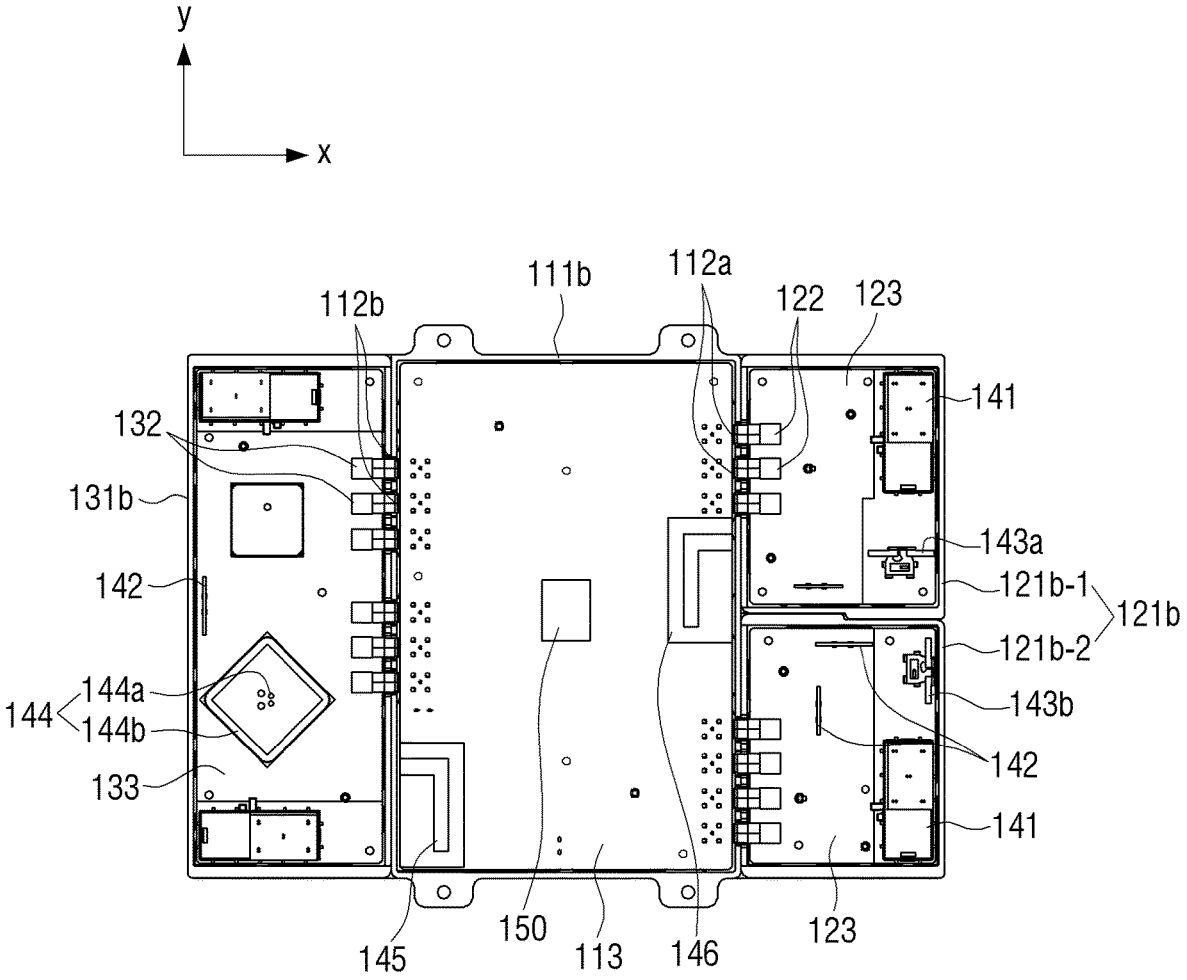
FIG. 4 is a top plan view of a communication apparatus for a vehicle with a cover omitted.
Figure 5:
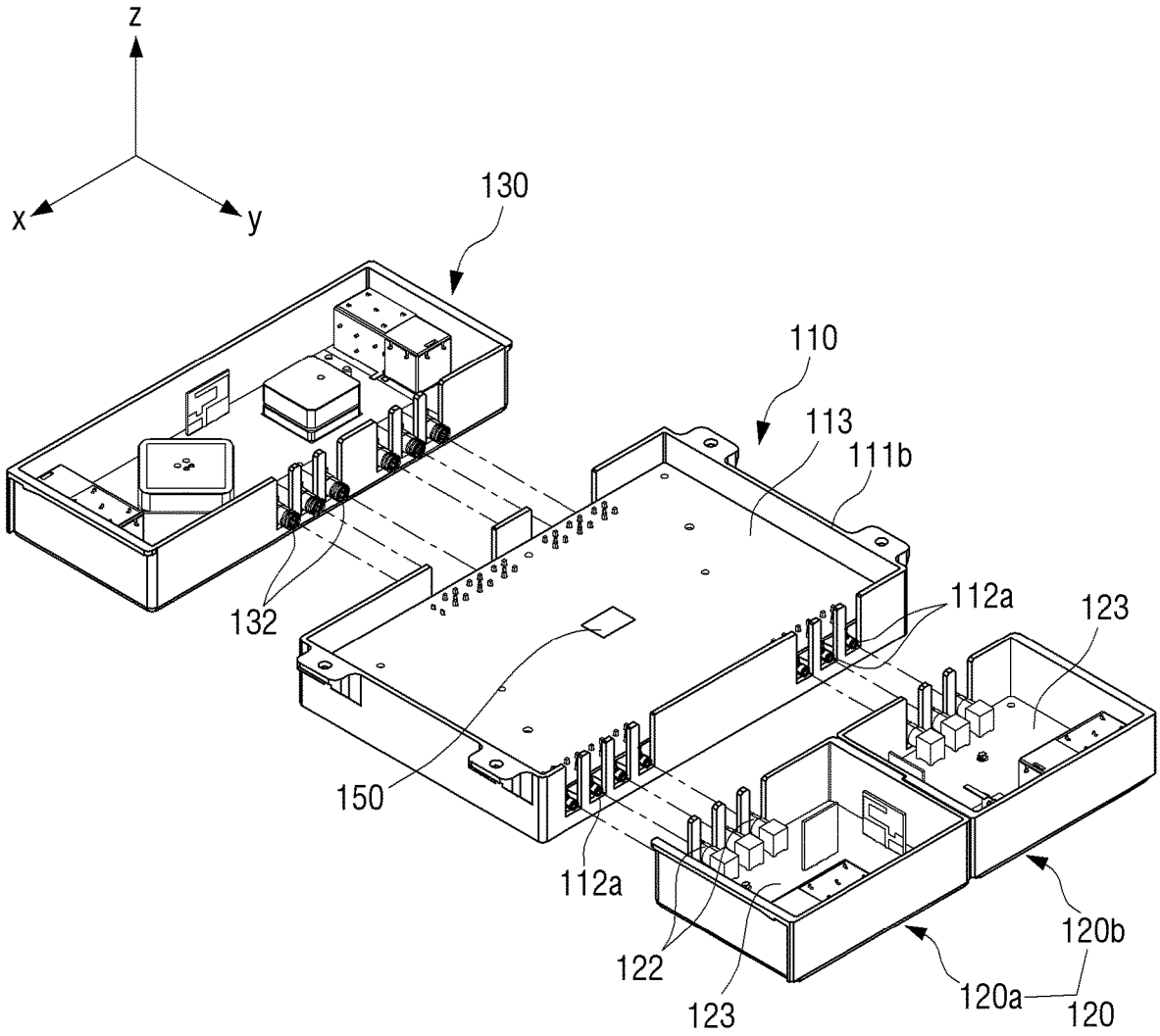
FIG. 5 is an exploded perspective view illustrating a communication interface unit and first and second antenna modules.

FIG. 2 is a perspective view illustrating the communication apparatus for a vehicle 100 according to an embodiment of the disclosure, FIG. 3 is an exploded perspective view illustrating the communication apparatus for a vehicle 100 according to an embodiment of the disclosure, FIG. 4 is a top plan view of the communication apparatus for a vehicle 100 with covers 111*a*, 121*a* and 131*a* omitted, and FIG. 5 is an exploded perspective view illustrating a communication interface unit 110 and first and second antenna modules 120 and 130.

The communication apparatus for a vehicle 100 may include first and second antenna modules 120 and 130 including a plurality of antennas and a communication interface unit 110 configured to processes signal information transmitted and received from the first and second antenna modules 120 and 130.

The communication interface unit 110 may include a first case 111 configured to form an outer surface, a processor 150 disposed inside of the first case 111, and a plurality of first receptacle terminals 112*a* electrically connected with the processor 150 and disposed at a first side of the first case 111.

Here, the first side may refer to a side surface of the first case 111 of the communication interface unit 110.

The first case 111 may form an outer surface of the communication interface unit 110, and include a first case cover 111*a* disposed at an upper portion and a first case body portion 111*b* connected with the first case cover 111*a*.

Accordingly, the first case 111 may encase the processor 150 and a printed circuit board 113 disposed inside the first case 111, and prevent foreign substances from the outside from being introduced inside of the communication interface unit 110.

The first case 111 may be configured in a material for shielding the inside of the communication interface unit 110. However, in case additional antennas 145 and 146 are disposed inside the first case 111 of the communication interface unit 110, it may be configured in a material through which signals may pass.

For example, the first case 111 may be comprised of a metal material or plastic injection molded.

In addition, the first case cover 111*a* may form a roof of the vehicle 1.

The processor 150 may be disposed on the printed circuit board 113 which is disposed inside the first case 111, and may be electrically connected with the plurality of antennas and process information transmitted and received from the plurality of antennas.

The processor 150 may include one or more from among a central processing unit (CPU), a controller, an application processor (AP), a communication processor (CP), or an ARM processor.

The printed circuit board 113 may include a patterned surface for electrically connecting the processor 150 with the plurality of antennas. Further, the parts other than the patterned parts of the printed circuit board 113 may be configured of a non-conductive material and perform a role of contacting the plurality of antennas.

The plurality of first receptacle terminals 112*a* may be disposed at the first side of the first case 111, and the plurality of first receptacle terminals 112*a* may be disposed at one surface of the printed circuit board.

The plurality of first receptacle terminals 112*a* may be comprised of a conductive material, and may be electrically connected with the processor 150 through the printed circuit board.

The plurality of first receptacle terminals 112*a* may be electrically and physically connected with a plurality of first connection terminals 122 of the first antenna module 120 which will be described below.

For example, the plurality of first receptacle terminals 112*a* may be physically connected with the plurality of first connection terminals 122 in a variety of methods such as, for example, and without limitation, screw coupling, snap coupling, or the like.

Thus, because the plurality of first receptacle terminals 112*a* and the plurality of first connection terminals 122 are comprised of a conductive material, the plurality of first receptacle terminals 112*a* and the plurality of first connection terminals 122 may be electrically connected.

As described above, the plurality of first receptacle terminals 112*a* may send a signal transmitted and received from an antenna of the first antenna module 120 which is electrically connected with the plurality of first connection terminals 122 to the processor 150.

In addition, a one end portion of the plurality of first receptacle terminals 112*a* may be of a circular shape, and a thread may be formed at an outer circumferential surface. Accordingly, the plurality of first receptacle terminals 112*a* may be inserted to the plurality of first connection terminals 122 which connects with the plurality of first receptacle terminals 112*a*, and the thread at the outer circumferential surface of the plurality of first receptacle terminals 112*a* may be coupled with a thread formed at an inner circumferential surface of a one end portion of the plurality of first connection terminals 122.

Further, the plurality of first receptacle terminals 112*a* may include an insertion part in which the plurality of first connection terminals 122 may be inserted, and an inner circumference of the insertion part may be greater than an outer circumference of the plurality of first connection terminals 122.

Accordingly, through the structure of the plurality of first connection terminals 122 being inserted to each of the plurality of first receptacle terminals 112*a*, the communication interface unit 110 and the first antenna module 120 may be more stably connected.

The plurality of first receptacle terminals 112*a* may be the same or greater than the number of the plurality of first connection terminals 122. Accordingly, not only the first antenna module 120, but also an additional antenna module may be connected to the communication interface unit 110 through the plurality of first receptacle terminals 112*a*.

That is, antenna modules of various sizes including a separate antenna may be coupled integrally with the communication interface unit 110 in the plurality of first receptacle terminals 112*a*.

In addition, the plurality of first receptacle terminals 112*a* may be disposed at an edge area of the first case 111 of the communication interface unit 110. That is, the plurality of first receptacle terminals 112*a* may be disposed at the side surface of the first case 111 of the communication interface unit 110.

Further, the communication interface unit 110 may include at least one from among a BLE antenna 145 and a WiFi antenna 146 which are disposed inside of the communication interface unit 110.

For example, as illustrated in FIG. 4, the BLE antenna 145 and the WiFi antenna 146 may be disposed connected with the printed circuit board 113 of the communication interface unit 110.

The BLE antenna 145 and the WiFi antenna 146 have been illustrated as a patch antenna, but antennas of various types such as, for example, and without limitation, a dipole antenna, a monopole antenna, a slot antenna, or the like may be used, if necessary.

Here, the Bluetooth lower energy may be a short-range communication using a base of 2.4 Ghz frequency band. The Bluetooth lower energy (BLE) is configured such that a duty cycle is several milliseconds (ms) and power consumption is very low since most of the time is spent in a sleep mode. Further, although a bandwidth of 2 MHz is used and a transmission rate of 1 Mbps is supported, an average transmission rate may be smaller than or equal to 200 k 엔 because the duty cycle is short.

In addition, the wireless fidelity (WiFi) may be one of the communication methods for electronic apparatuses to connect to a wireless LAN (WLAN), and generally a 2.4 GHz UHF and a 5 GHz SHF ISM wireless band may be used.

The communication interface unit 110 may be a Telematics control unit (TCU).

The first antenna module 120 may include the plurality of first connection terminals 122 which is coupled to be directly separable from the plurality of first receptacle terminals 112*a* and a first antenna 141, 142, 143*a* and 143*b*, which is electrically connected with at least one from among the plurality of first connection terminals 122.

The plurality of first connection terminals 122 may be disposed at a side surface edge of the first antenna module 120, and connected with the printed circuit board 123 which is disposed inside of the first antenna module 120.

Specifically, the plurality of first connection terminals 122 may be disposed at one surface of the printed circuit board 123 which is disposed inside the first antenna module 120.

Further, the plurality of first connection terminals 122 may be comprised of a conductive material, and electrically connected with the plurality of first antennas 141, 142, 143*a* and 143*b* through the printed circuit board 123.

The plurality of first connection terminals 122 may be electrically and physically connected with the plurality of first receptacle terminals 112*a* of the 는 communication interface unit 110.

Accordingly, the first antenna module 120 may be connected with the communication interface unit 110 as one body, and the signal transmitted and received to and from the first antenna included in the first antenna module 120 may be sent to the communication interface unit 110.

Thus, a loss of signal may be prevented due to the structure in which the first antenna module 120 and the communication interface unit 110 are adjoined.

In addition, the first antenna module 120 may save on manufacturing cost because the communication interface unit 110 is integrally formed without a separate cable.

Further, the first antenna module 120 may be implement as the communication apparatus for a vehicle 100 of a miniaturized size because the communication interface unit 110 is integrally formed, and may be disposed at various positions of the vehicle if necessary.

Accordingly, the signal received from each of the first antenna 141, 142, 143*a* and 143*b* may be sent to the processor 150 of the communication interface unit 110 through the first connection terminal 122 and the first receptacle terminal 112*a*.

The plurality of first connection terminals 122 may have a number corresponding to the number of antennas included in the first antenna module 120. Accordingly, each of the plurality of first connection terminals 122 may send signals transmitted and received to and from different antennas from one another to the communication interface unit 110 without interference.

The plurality of first connection terminals 122 may be the same or smaller than the number of the plurality of first receptacle terminals 112*a*.

Accordingly, with respect to the communication interface unit 110 which includes the plurality of first receptacle terminals 112*a*, an antenna module having a plurality of connection terminals may be coupled to the communication interface unit 110.

For example, based on the plurality of first receptacle terminals 112*a* being an n number, the antenna module having an m number connection terminals which is smaller than the n number may be connected to the plurality of first receptacle terminals 112*a*. Further, an antenna module having a connection terminal number of n−m number may be coupled to the plurality of first receptacle terminals 112*a* of n−m number which are not coupled.

Here, m and n may be natural numbers greater than 0.

That is, as illustrated in FIG. 4, based on the number of the plurality of first connection terminals 112*a* being seven, a second body portion 121*b*-1 each of which includes antennas different from one another may be connected with a portion of the plurality of first receptacle terminals 112*a* through three connection terminals 132, and a third body portion 121*b*-2 may be connected with the remaining of the plurality of first receptacle terminals 112*a* through four connection terminals 132.

Accordingly, each antenna module which includes antennas of various sizes and types according to a frequency of the signal to be transmitted and received may be integrally connected to the communication interface unit 110 simultaneously.

In addition, based on the frequency of the signal to be transmitted and received being changed, an antenna module provided with an antenna including the same may be switched and coupled to the communication interface unit 110, and a signal of a new frequency domain may be transmitted and received without significant switching of hardware by updating a software of the communication interface unit 110.

Further, based on the antenna being switched because a required frequency which services according to the rapidly changing communication technology is changed, a communication service necessary in each instance may be provided to a user by switching only an antenna module 100 for a vehicle or the first antenna module 120, without change in a vehicle structure.

The first antenna module 120 may be integrally coupled to a side surface of the communication interface unit 110 through the first connection terminal 122. Specifically, the first antenna module 120 may be coupled to be separable from the side surface of the first case 111 of the communication interface unit 110.

That is, based on the plurality of first receptacle terminals 112*a* and the plurality of first connection terminals 122 being connected, the communication interface unit 110 and the first antenna module 120 may be coupled as one body.

The first antenna 141, 142, 143*a* and 143*b* may include antennas of various types. Specifically, the first antenna may include antennas of various types such as, for example, and without limitation, a monopole antenna 141, a patch antenna 142, dipole antennas 143*a* and 143*b*, or the like.

Here, the monopole antenna 141 may, as an antenna having a vertical linear or spiral conductor that operates with half of the dipole antenna, include antennas of various types such as, for example, and without limitation a blade type, a quadrifilar helix type, or the like.

In addition, the patch antenna 142 may be an antenna which is formed in a rectangular or circular metal form on a microstrip substrate and fed.

Further, the first antenna module 120 may include various antennas such as, for example, and without limitation, a 4×4 4G LTE MIMO antenna, a GPS antenna, a GNSS antenna (L1, L2 and L5 band), a satellite digital audio radio service (SDARS) antenna, a WiFi MIMO antenna, a Bluetooth antenna, a C2X antenna, a V2X antenna, or the like.

The dipole antennas 143*a* and 143*b*, in which the antenna length is a half wavelength, may be antennas that function like a dipole which is fed from a center portion of a wire and linear potential distributions and polarities are always symmetrical vertically and horizontally based on a center of the antenna.

Further, the first antenna module 120 may include a first dipole antenna 143*a* and a second dipole antenna 143*b* which is disposed so that a radiation direction is different from the first dipole antenna 143*a*.

Specifically, the first dipole antenna 143*a* may be disposed in a minor axis direction (X-axis direction) of the first antenna module 120, and the second dipole antenna 143*b* may be disposed in a major axis direction (Y-axis direction) of the first antenna module 120.

Accordingly, the signal radiated from the first dipole antenna 143*a* may interfere with the signal radiated from the second dipole antenna 143*b*, and each of the signals may be amplified and the sensitivity of the signals transmitted and received from the first and second dipole antennas 143*a* and 143*b* may be enhanced.

That is, through the structure which is disposed mutually perpendicular of the first and second dipole antennas 143*a* and 143*b*, radiation efficiency may be enhanced.

Thus, the first antenna may include antennas of various sizes and types according to the frequency for transmitting and receiving.

Accordingly, the communication apparatus for a vehicle 100 may transmit and receive various signals of the various frequency bands.

In addition, the communication interface unit 110 may further include a plurality of second receptacle terminals 112*b* which is disposed at a second side of the first case 111. Accordingly, the communication interface unit 110 may be configured so that the first antenna module 120 is connected to the first side of the communication interface unit 110, and the second antenna module 130 is connected to the second side which is different from the first side.

Here, the second side may be a side surface which is different from the first side, and the second side may refer to a side surface facing the first side.

Accordingly, the second antenna module 130 may be disposed to face the first antenna module 120. Thus, through the arrangement in which the second antenna module 130 and the first antenna module 120 are spaced apart, the signal transmitted and received from the second antenna module 130 interfering with the signal transmitted and received from the first antenna module 120 may be prevented, and the sensitivity of the signals may be enhanced.

Specifically, through the arrangement in which the second antenna module 130 and the first antenna module 120 are spaced apart, each of the antenna modules may be disposed so that electromagnetic mutual coupling and isolation are optimized between the antennas included therein, and the isolation between the antennas with the same resonant frequency may be maximized.

The second antenna module 130 may include a plurality of second connection terminals 132 which is coupled to be directly separable with the plurality of second receptacle terminals 112*b* and second antennas 142 and 144 which are electrically connected with the plurality of second connection terminals 132.

The plurality of second connection terminals 132 may include a number corresponding to the number of antennas included in the second antenna module 130. Accordingly, each of the plurality of second connection terminals 132 may send the signal transmitted and received through antennas different from one another to the communication interface unit 110 without interference.

The plurality of second connection terminals 132 may be the same or smaller than the number of the plurality of second connection terminals 132.

Accordingly, the communication interface unit 110 which includes the plurality of second receptacle terminals 112*b* may be configured so that an antenna module having connection terminals of various numbers is coupled to the communication interface unit 110.

The second antennas 142 and 144 disposed on the printed circuit board 133 have been illustrated as including the patch antenna 142 and a dipole antenna 144, but antennas of various forms such as the monopole antenna and the slot antenna may be coupled thereto.

Here, the dipole antenna 144 may include a vertical antenna device 144*a* and an external part 144*b* which is disposed around the antenna device 144*a* fixing the antenna device 144*a* and forms an external shape.

Figure 6:
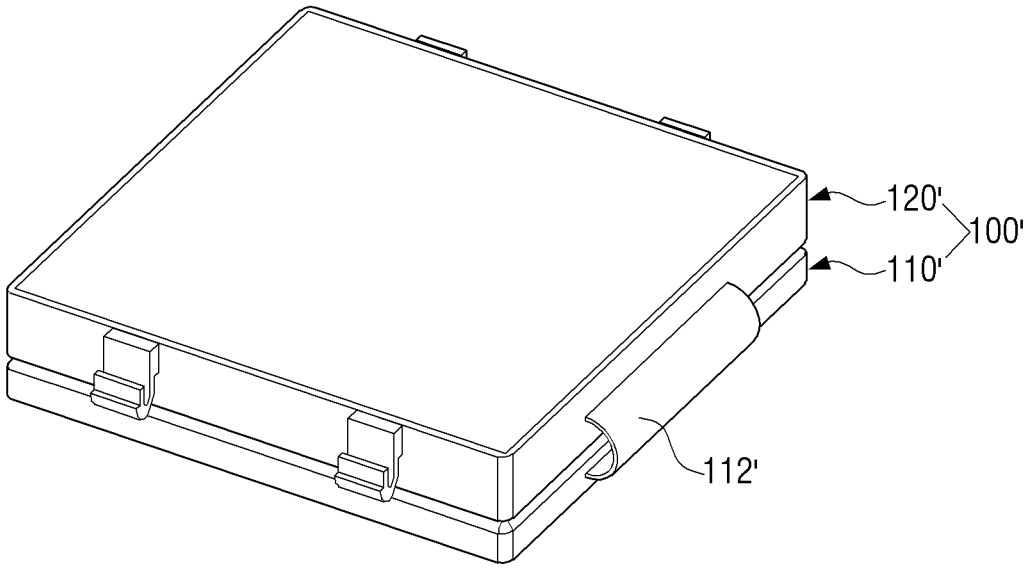
FIG. 6 is a perspective view illustrating a communication apparatus for a vehicle according to a modified embodiment of the disclosure.

FIG. 6 is a perspective view illustrating the communication apparatus for a vehicle 100' according to a modified embodiment of the disclosure.

The communication apparatus for a vehicle 100' may include a communication interface unit 110' which is changed only in shape from the external shape of above-described communication interface unit 110 and a first antenna module 120' which is snap coupled with the communication interface unit 110' at an upper surface of the communication interface unit 110'.

The communication interface unit 110' and the first antenna module 120' of the communication apparatus for a vehicle 100' may be electrically interconnected through a connection member 112' comprised of a cable or film which includes a conductive material, and not electrically connected through the plurality of first receptacle terminals 112*a* and the plurality of first connection terminals 122.

That is, the communication interface unit 110' and the first antenna module 120' may be physically connected through the snap coupling, and electrically connected through the connection member 112'.

Accordingly, the first antenna module 120' may be disposed integrally at the various side surfaces of the communication interface unit 110'.

The structure of the communication apparatus for a vehicle 300 according to another embodiment of the disclosure will be described below with reference to FIGS. 7 to 8.

Figure 7:
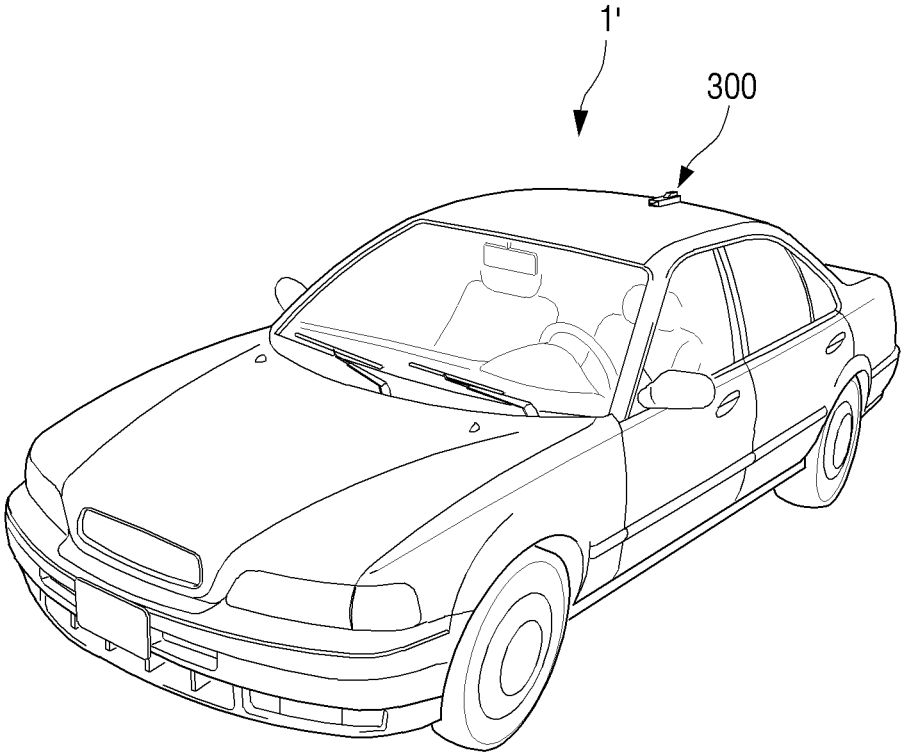
FIG. 7 is a perspective view illustrating a vehicle according to another embodiment of the disclosure.
Figure 8:
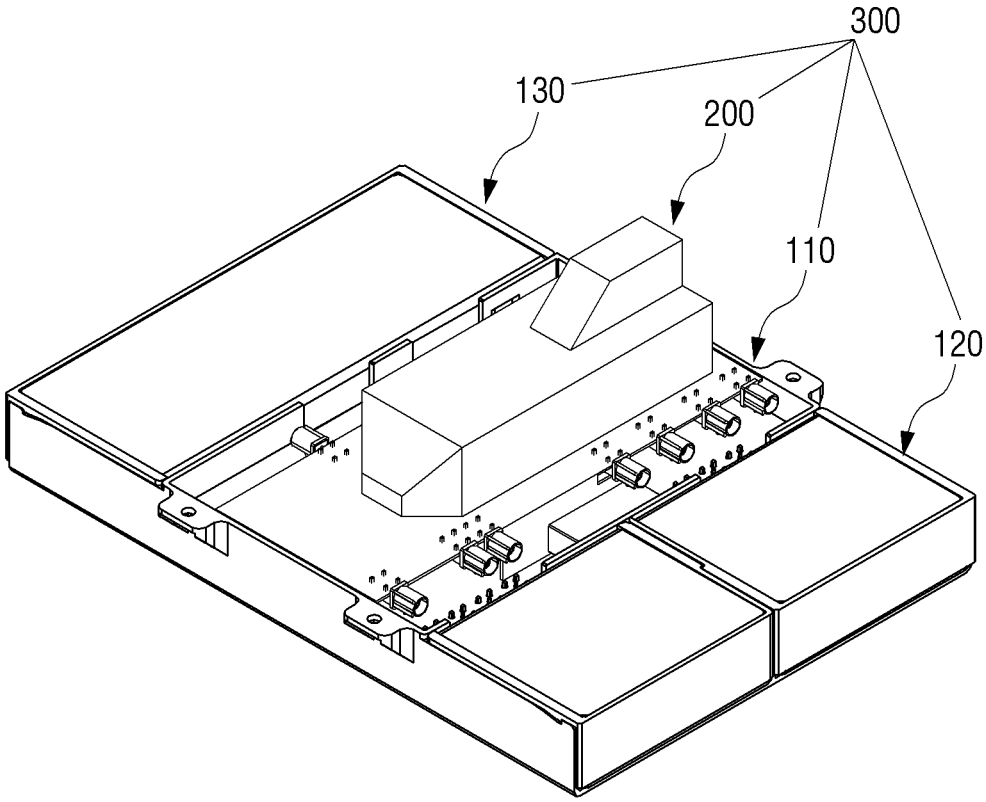
FIG. 8 is a perspective view illustrating a communication apparatus for a vehicle according to another embodiment of the disclosure.

FIG. 7 is a perspective view illustrating a vehicle 1' according to another embodiment of the disclosure, FIG. 8 is a perspective view illustrating the communication apparatus for a vehicle 300 according to another embodiment of the disclosure.

The communication interface unit 110, the first antenna module 120, and the second antenna module 130 illustrated in FIG. 8 have used the same reference numerals as with the above-described configurations, and because it is the same configuration, redundant descriptions thereof will be omitted.

The communication apparatus for a vehicle 300 may include a communication interface unit 110, a first antenna module 120, a second antenna module 130, and a third antenna module 200.

The third antenna module 200 may be disposed at an upper surface of the communication interface unit 110. Specifically, the third antenna module 200 may be disposed at a position which a cover 111*a* of the communication interface unit 110 is disposed.

More specifically, the printed circuit board 202 of the printed circuit board 202 may be connected with the first case body portion 111*b* at the upper surface of the first case body portion 111*b* of the communication interface unit 110.

Accordingly, the third antenna module 200 may be coupled with the communication interface unit 110 as one body.

Further, because the third antenna module 200 is protrudingly disposed at an upper portion of a roof of the vehicle 1', the efficiency of the signal transmitted and received to and from the third antenna module 200 may be enhanced.

The specific structure of the third antenna module 200 will be described below with reference to FIGS. 9 to 12.

Figure 9:
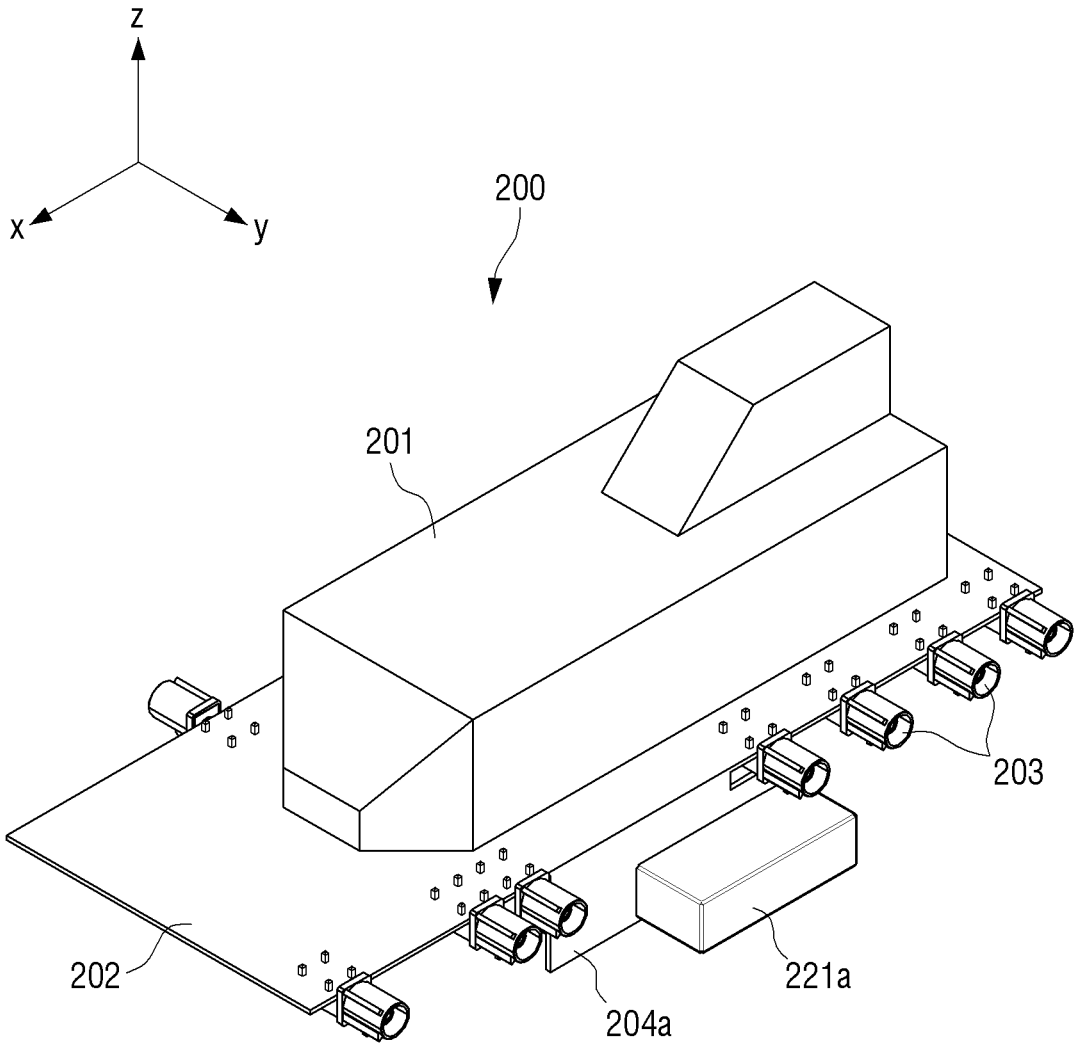
FIG. 9 is a perspective view illustrating a third antenna module according to another embodiment of the disclosure.
Figure 10:
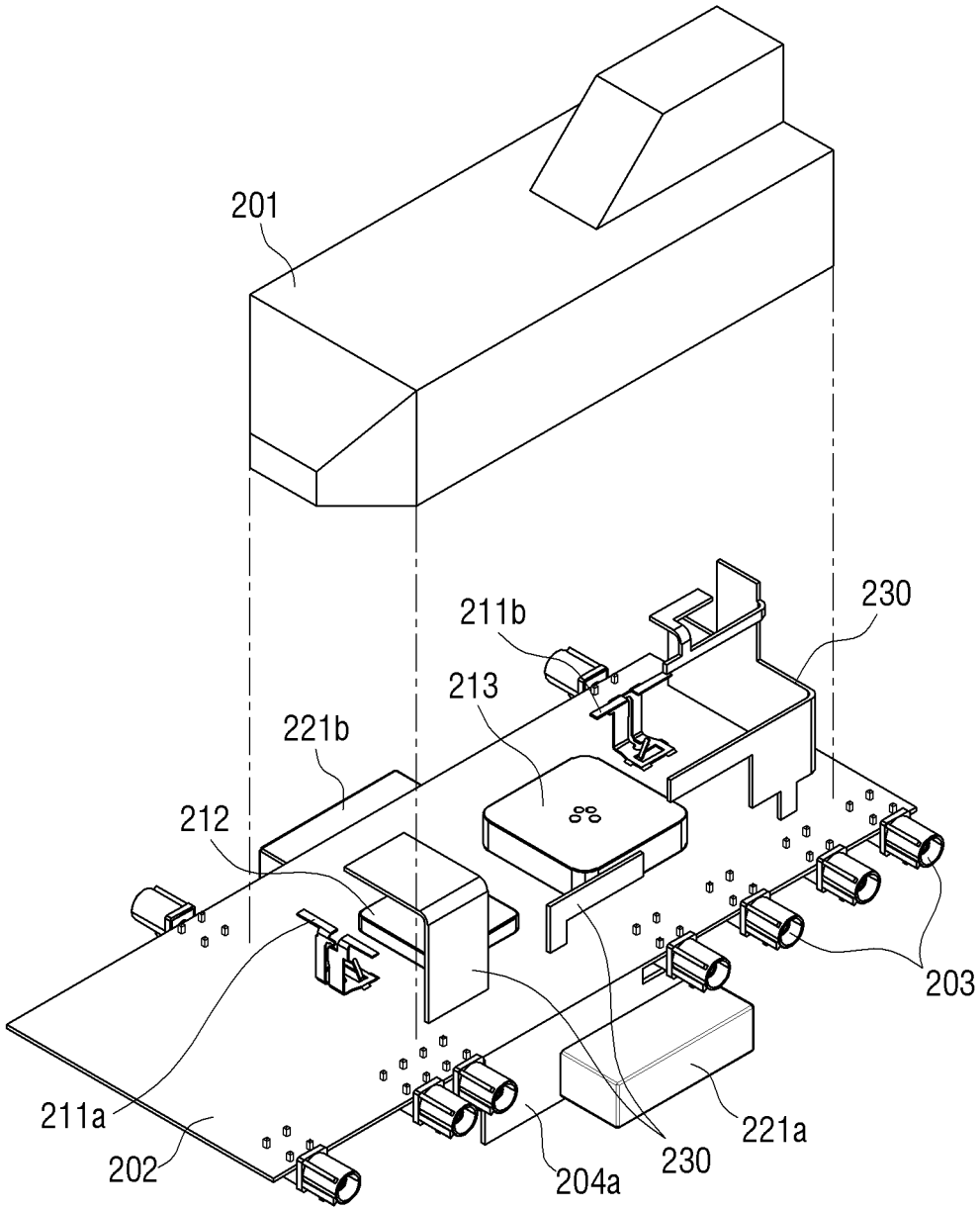
FIG. 10 is an exploded perspective view illustrating a third antenna module.
Figure 11:
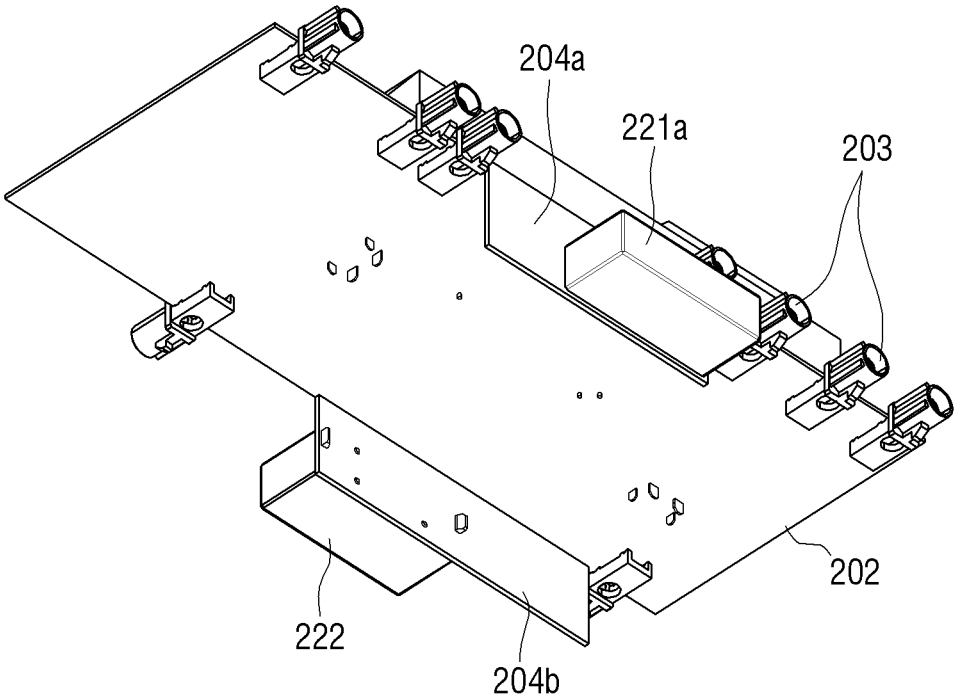
FIG. 11 is a lower perspective view illustrating a third antenna module.
Figure 12:
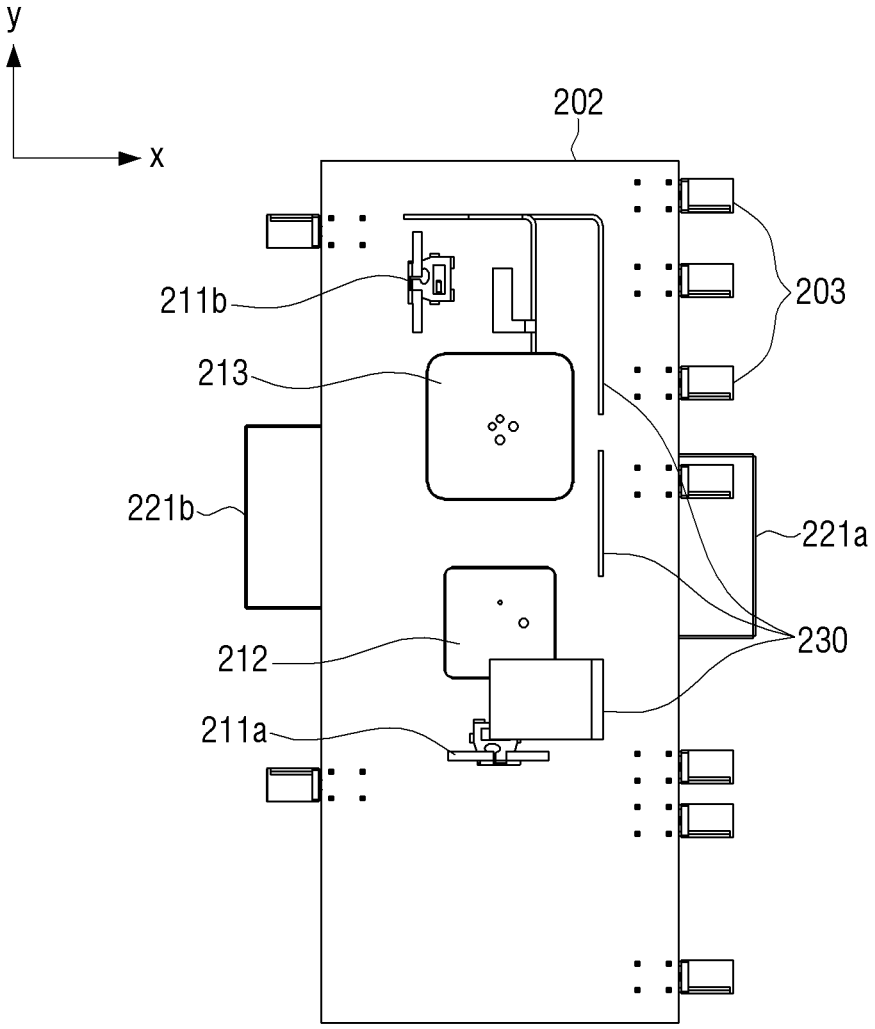
FIG. 12 is a top plan view illustrating a third antenna module with a case omitted.

FIG. 9 is a perspective view illustrating the third antenna module 200 according to another embodiment of the disclosure, FIG. 10 is an exploded perspective view illustrating the third antenna module 200, FIG. 11 is a lower perspective view illustrating the third antenna module 200, and FIG. 12 is a top plan view illustrating the third antenna module 200 with a case 201 omitted.

The third antenna module 200 may include a second case 201 of a shark fin shape, the printed circuit board 202 which forms a lower surface of the second case 201, and at least one of the third antennas 211*a*, 211*b*, 212 and 213 disposed on the printed circuit board 202.

The second case 201 may be disposed at the upper surface of the printed circuit board 202, and may form an overall exterior of the third antenna module 200.

Further, the second case 201 may be in the shark fin shape which is a streamlined form. Accordingly, even if the third antenna module 200 is protrudingly disposed at an upper portion of the roof of the vehicle 1', air resistance may be reduced.

The second case 201 may not only be directly connected to the printed circuit board 202, but also may be supported by a support member 230 which contacts with an inner surface of the second case 201.

Here, the support member 230 may be comprised of a shape corresponding to the shape of the second case 201 according to the shape of the second case 201, and connected to the printed circuit board 202.

Accordingly, the second case 201 may be stably fixed on the printed circuit board 202.

The third antennas 211*a*, 211*b*, 212 and 213 may include the monopole antennas 212 and 213 and dipole antennas 211*a* and 211*b* which are the same as the above-described monopole antenna 141 and the dipole antennas 143*a* and 143*b*.

However, the third antenna may include antennas of various sizes and types to transmit and receive signals of various frequency bands.

Further, the third antenna module 200 may include at least one of the fourth antennas 221*a* and 221*b* which are disposed at the lower part of the printed circuit board 202.

Further, the at least one of the fourth antennas 221*a* and 221*b* may be disposed on the extending surfaces 204*a* and 204*b* which is connected to the lower surface of the printed circuit board 202.

Specifically, the third antenna module 200 may further include the first additional antenna 221*a* and the second additional antenna 221*b* which is disposed to face the first additional antenna 221*a*.

Accordingly, the first and second additional antennas 221*a* and 221*b* may operate as at least one of the third antennas 211*a*, 211*b*, 212 and 213 and a multi-input multi-output antenna (MIMO antenna).

Here, the MIMO may be a smart antenna technology for raising the capacity of wireless communication. The MIMO may mean using several antennas in the base station and the terminal, and raising capacity proportionate to the number of used antennas.

Thus, the first and second additional antennas 221*a* and 221*b* may transmit and receive signals of various frequency bands by increasing the capacity of wireless communication.

Further, the extending surface may include a first extending surface 204*a* on which the first additional antenna 221*a* is disposed and a second extending surface 204*b* which is spaced apart from the first extending surface 204*a* and disposed to face each other, and on which the second additional antenna 221*b* is disposed.

Accordingly, through the structure spaced apart between the first additional antenna 221*a* and the second additional antenna 221*b*, the signal transmitted and received from the first additional antenna 221*a* and the signal transmitted and received from the second additional antenna 221*b* may interfere with each other, and may prevent the sensitivity of the signals from deteriorating.

For example, if the first additional antenna 221*a* and the second additional antenna 221*b* transmit and receive signals having different frequency domains from one another which is not the MIMO antenna, the sensitivity of each of the signals may be enhanced through isolation between the first additional antenna 221*a* and the second additional antenna 221*b*.

Further, the first additional antenna 221*a* and the second additional antenna 221*b* may be disposed inside of the first case 111 of the communication interface unit 110. Thus, the sensitivity of each of the signals may be enhanced through isolation between the first additional antenna 221*a* and the second additional antenna 221*b*.

In addition, the extending surface may be comprised of the same material as the printed circuit board 202, and may be physically and electrically connected with the printed circuit board 202.

Accordingly, the first additional antenna 221*a* and the second additional antenna 221*b* which are disposed on the extending surface may send a signal to the communication interface unit 110 through the third receptacle terminal 203.

Further, the third receptacle terminal 203 may be disposed on the printed circuit board 202. Specifically, the third receptacle terminal 203 may be disposed at the edge area of the printed circuit board 202, and may be physically and electrically connected with the printed circuit board 202.

Accordingly, the signal transmitted and received from at least one of the fourth antenna 221*a* and 221*b*, the first additional antenna 221*a*, and the second additional antenna 221*b*, which are electrically connected with the printed circuit board 202 may be sent to the communication interface unit 110 through the third receptacle terminal 203.

Because the specific structure of the third receptacle terminal 203 is the same as the first receptacle terminal 112*a* described above, redundant descriptions thereof will be omitted.

Further, the number of third receptacle terminals 203 may be comprised of at least one or more according to necessity.

At least a portion of the apparatus (e.g., modules or functions thereof) or method (e.g., operations) according to various embodiments may be implemented as an instruction stored in a computer readable storage medium (e.g., memory 3430) in the form of a program module. If the instruction is executed by the processor (e.g., processor 3420), the processor may perform a function corresponding to the instruction. The computer readable storage medium may include a hard disk, a floppy disk, a magnetic media (e.g., magnetic tape), an optical media (e.g., CD-ROM, DVD), a magneto-optical media (e.g., floptical disk), an embedded memory, or the like. The instructions may include a code generated by a compiler or a code executed by an interpreter.

Each of the elements (e.g., a module or a program) according to various embodiments may be comprised of a single entity or a plurality of entities, and some sub-elements of the abovementioned sub-elements may be omitted or other sub-elements may be further included in various embodiments. Alternatively or additionally, some elements (e.g., modules or program modules) may be integrated into one entity to perform the same or similar functions performed by each respective element prior to integration. Operations performed by a module, a program module, or other element, in accordance with various embodiments, may be performed sequentially, in parallel, repetitively, or in a heuristically manner, or at least some operations may be performed in a different order, omitted, or may add a different operation.

In the above, various embodiments of the disclosure have been described respectively and individually, but each embodiment may not necessarily be implemented on its own, and the configuration and operations of each embodiment may be implemented in combination with at least one other embodiment.

In addition, while the disclosure has been shown and described with reference to the exemplary embodiments thereof, the disclosure is not limited to the embodiments specifically described and various modifications may be made therein by those skilled in the art to which this disclosure pertains without departing from the spirit and scope of the disclosure, and such modifications shall not be understood as separate from the technical concept or outlook of the present disclosure.

What is claimed is:

1. A communication apparatus for a vehicle, comprising:

a communication interface comprising a first case forming an outer surface, a processor disposed inside the first case, and a plurality of first receptacle terminals configured to be electrically connected with the processor and disposed at a first side surface of the first case; and a first antenna module comprising a plurality of first connection terminals coupled to be directly separable from the plurality of first receptacle terminals and a first antenna electrically connected with at least one from among the plurality of first connection terminals, wherein, based on the plurality of first receptacle terminals and the plurality of first connection terminals being connected, the communication interface and the first antenna module are coupled as one body, wherein the first antenna module is coupled to be separable from the first side surface of the first case, wherein the communication interface further comprises a plurality of second receptacle terminals disposed at a second side surface of the first case facing the first side surface, wherein the communication apparatus for a vehicle further comprises a second antenna module comprising a plurality of second connection terminals coupled to be directly separable from the plurality of second receptacle terminals and a second antenna which is electrically connected with the plurality of second connection terminals, wherein the second antenna module is disposed to face the first antenna module, wherein the communication apparatus for a vehicle further comprises a third antenna module, and wherein the third antenna module comprises:

a second case of a shark fin shape;

a printed circuit board forming a lower surface of the second case; and at least one third antenna disposed on the printed circuit board.

2. The communication apparatus for a vehicle of claim 1, wherein the communication interface and the first antenna module are disposed at a lower portion of a roof of a vehicle.

3. The communication apparatus for a vehicle of claim 1, wherein the plurality of first connection terminals comprises connection terminals of a number corresponding to a number of antennas comprised in the first antenna module, and wherein a number of the plurality of first receptacle terminals is the same or more than a number of the plurality of first connection terminals.

4. The communication apparatus for a vehicle of claim 1, wherein the first antenna module comprises:

a first dipole antenna; and a second dipole antenna disposed so that a radiation direction is different from the first dipole antenna.

5. The communication apparatus for a vehicle of claim 4, wherein the first dipole antenna is disposed in a minor axis direction of the first antenna module, and the second dipole antenna is disposed in a major axis direction of the first antenna module.

6. The communication apparatus for a vehicle of claim 1, wherein the third antenna module is disposed at an upper surface of the communication interface.

7. The antenna apparatus for a vehicle of claim 1, wherein the third antenna module further comprises at least one fourth antenna disposed at a lower portion of the printed circuit board.

8. The antenna apparatus for a vehicle of claim 7, wherein the at least one fourth antenna is disposed at an extending surface which is connected to a lower surface of the printed circuit board.

9. The antenna apparatus for a vehicle of claim 8, wherein the third antenna module further comprises:

a first additional antenna; and a second additional antenna disposed to face the first additional antenna, wherein the extending surface comprises:

a first extending surface on which the first additional antenna is disposed; and a second extending surface disposed spaced apart from the first extending surface to face each other, and on which the second additional antenna is disposed.

10. The antenna apparatus for a vehicle of claim 9, wherein the at least one third antenna and the first and second additional antennas are configured to operate as a MIMO antenna.

11. The antenna apparatus for a vehicle of claim 1, wherein the communication interface comprises at least one from among a BLE antenna and a WiFi antenna.

* * * * *